US010260847B2

(12) United States Patent
Viggiano et al.

(10) Patent No.: US 10,260,847 B2
(45) **Date of Patent: *Apr. 16, 2019**

(54) FIRE ARM CASING AND CARTRIDGE

(71) Applicant: Shell Shock Technologies LLC, Westport, CT (US)

(72) Inventors: Anthony Viggiano, Groton, CT (US); Volodymyr Drobockyi, Hebron, CT (US)

(73) Assignee: SHELL SHOCK TECHNOLOGIES LLC, Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/221,530

(22) Filed: Jul. 27, 2016

(65) Prior Publication Data

US 2017/0030690 A1 Feb. 2, 2017

Related U.S. Application Data

(60) Provisional application No. 62/197,472, filed on Jul. 27, 2015.

(51) Int. Cl.
*F42B 5/285* (2006.01)
*F42B 33/04* (2006.01)
(Continued)

(52) U.S. Cl.
CPC ..... *F42B 5/285* (2013.01); *F42B 33/001* (2013.01); *F42B 33/0207* (2013.01); *F42B 33/04* (2013.01); *F42C 19/0807* (2013.01)

(58) Field of Classification Search
CPC ..... F42B 5/285; F42B 5/292; F42B 5/295; F42B 5/297; F42B 5/307; F42B 5/313;
(Continued)

(56) References Cited

U.S. PATENT DOCUMENTS 125,830 A 4/1872 Milbank
640,856 A 1/1900 Bailey
(Continued)

FOREIGN PATENT DOCUMENTS

EP 543954 A1 9/2013
GB 498080 1/1939
(Continued)

OTHER PUBLICATIONS

U.S. Appl. No. 15/221,558, V. Drobockyi et al., "Method of making casing an cartridge for fire arm".
(Continued)

*Primary Examiner* — Bret Hayes
(74) *Attorney, Agent, or Firm* — C. Nessler

(57) ABSTRACT

A casing for use in a cartridge for a firearm comprises a sleeve and attached base. The sleeve has cylindrical portion with a mouth for holding a bullet and an opposing bulkhead from which extends a nipple. At the terminal end of the nipple is a lip that radially decreases in thickness and has curved surface portions; the lip forms a first seal region within a passageway that runs through the base. Preferably a second seal zone around the nipple near the bulkhead. A bulkhead comprises a circumferential wave or ridge that creates a hollow on the surface facing the base. A sleeve is preferably made of austenitic stainless steel that has differential hardness and magnetic properties along the sleeve length; and the base has a hardness less than any portion of the sleeve.

35 Claims, 7 Drawing Sheets

(51) Int. Cl.
*F42C 19/08* (2006.01)
*F42B 33/00* (2006.01)
*F42B 33/02* (2006.01)

(58) Field of Classification Search
CPC .... F42B 33/001; F42B 33/0207; F42B 33/04; F42C 19/0823; F42C 19/0826; F42C 19/083; F42C 19/10
USPC ..... 102/464–470, 204; 86/12, 18, 19.5, 19.8
See application file for complete search history.

(56) References Cited

U.S. PATENT DOCUMENTS 2,654,319 A 10/1953 Roske
2,823,611 A * 2/1958 Thayer ..... F42B 5/285 102/469
3,099,958 A 8/1963 Duubenspeck
3,675,576 A 7/1972 Whitney
3,688,699 A 9/1972 Horn et al.
3,690,256 A * 9/1972 Schnitzer ..... F42B 5/307 102/465
3,745,924 A 7/1973 Scanlon et al.
3,765,297 A 10/1973 Skochko et al.
3,873,375 A 3/1975 Bolen et al.
3,977,326 A * 8/1976 Anderson ..... F42B 5/307 102/467
4,222,330 A * 9/1980 Krystyniak ..... F42B 5/02 102/430
5,106,431 A 4/1992 Nelson
5,272,983 A * 12/1993 Sippel ..... F42B 5/181 102/430
5,297,491 A * 3/1994 Sippel ..... F42B 5/26 102/430
5,969,288 A * 10/1999 Baud ..... F42B 5/313 102/466
5,979,331 A * 11/1999 Casull ..... F41A 15/12 102/464
7,980,178 B1 * 7/2011 Yalamanchili ..... C06B 33/08 102/204
8,186,273 B2 5/2012 Trivette
8,561,543 B2 10/2013 Burrow
9,091,516 B2 7/2015 Davies et al.
9,118,412 B2 8/2015 Maljkovic et al.
9,188,412 B2 11/2015 Maljkovic et al.
9,939,236 B2 * 4/2018 Drobockyi ..... F42B 5/285
2005/0268808 A1 12/2005 Werner
2007/0214992 A1 9/2007 Dittrich
2013/0180392 A1 7/2013 Nuetzman et al.
2014/0224144 A1 8/2014 Neugebauer
2015/0027019 A1 1/2015 Neergaard

FOREIGN PATENT DOCUMENTS

WO PCTUS07001479 7/2008
WO WO2008091245 A2 7/2008

OTHER PUBLICATIONS

ISA/US International Search Report, App PCT/US16/44322, dated Oct. 21, 2016, 14 pages.

* cited by examiner

20

FIRE ARM CASING AND CARTRIDGE

This application claims benefit of provisional patent application Ser. No. 62/197,472, filed Jul. 27, 2015 and provisional application Ser. No. 62/387,418 filed Dec. 24, 2015, the disclosures of which are hereby incorporated by reference.

TECHNICAL FIELD

The present invention relates cartridges for firearms, in particular to casings for ammunition.

BACKGROUND

In the field of firearms, ammunition cartridges (also called ammunition shells) contain powder, which when ignited propels a bullet down the barrel of a gun toward a target. Prior art cartridges, particularly those for use with small arms, typically comprise a casing made of forged brass. A propellant, typically smokeless explosive powder, is contained within the casing and is ignited by impact of a firing pin of the breech block of the gun on a primer that is set in a recess at the base of the casing.

A cartridge relevant to the present invention comprises a generally cylindrical casing having a substantially closed end, called here the base end, and an opposing open end, often called the mouth. The open end of the mouth receives a bullet after propellant is put into the concavity of the casing; and the casing is crimped as needed around the bullet to hold it in place. The base end of the casing typically has a cannelure or groove to enable the casing to be engaged by grips on the firing mechanism of a gun. The base end often comprises a larger diameter flange portion which acts as a stop, limiting the depth of insertion of the cartridge into the chamber of the barrel of the gun.

In prior art cartridges comprised of forged metal (typically cartridge brass) casings, the base end which holds the primer is integral with the sleeve portion which holds the bullet. Typically, the sleeve is tapered internally (with the larger diameter at the open end), attributable to the metal-working process by which the cartridge is formed. The wall thickness near the base may is as several times the thickness of the wall at the mouth end. Sometimes a casing has a step-down in diameter in vicinity of the open end, where the bullet is captured.

The exterior surface of the base of the typical cartridge has a recess within which is contained a percussion primer that contains a small quantity of impact-sensitive explosive powder. Typically the primer is in the center of the base and comprises an internal anvil which is supported during the firing process by the end of the recess. There is a small passageway through the base, often called the vent or flash hole, enabling ignited primer gases to pass through the base and into the concavity of the casing, to ignite the propellant.

A cartridge necessarily slip fits into a chamber of the barrel of the gun for which it is intended. A cartridge is typically inserted and held in place by the breech block (as called slide or bolt) which usually has one or more claws for grasping the a groove in the rim of the base of the casing. When the primer is struck by the firing pin within the breech block of the gun, the propellant explosively turns into gas and forces the bullet from the cartridge and down the bore of the barrel of the gun. In that process, the pressure of the deflagrated propellant gas expands the casing of the cartridge radially outwardly, desirably creating a seal against gas escape through the slip fit clearance region of the casing with the chamber. Then the casing hopefully relaxes, moving radially inwardly to about its original dimension, enabling the casing of the spent cartridge to be readily removed. A casing is often removed from the chamber by retracting action of the breech block which pulls on the cannelure; or by force of the pressurized gases on the casing in coordination with rearward motion of the breech block. After ejection from the breech area, a casing may often be recycled by replacing the primer and powder and installing a new bullet.

Good cartridges have a number of characteristics. They should be strong enough to resist the pressure of deflagration gases as just discussed. They should be configured for making a seal with the chamber of the gun during firing of a bullet. They should have over durability and integrity, including the ability to resist possible rough handling prior to placement in a firearm and the ability to be reworked and reloaded. They should be corrosion resistant. Traditionally, cartridges of brass alloys had worked well.

The brass of common and widely used traditional casings is a costly alloy compared to various iron and aluminum alloys, and of course, compared to plastic. However, alternative materials such as steels, aluminum alloys and plastics have found less favor in the marketplace, usually due to perceived deficiencies in the characteristics above.

Other inventors have described a variety of alternative constructions and materials for cartridges. For example: Cartridges may be made in whole or part from plastics and metals other than brass. The casing may be made of plastic or paper and attached to a metal base (as is common for shotgun shells). The casing may be made in the form of a sleeve having a nipple end which is inserted into a passageway in a base that runs to a primer, and the nipple is flared radially, to hold the two parts together. For reference see the following publications: Milbank U.S. Pat. No. 125,830; Horn U.S. Pat. No. 3,688,699; Skochko U.S. Pat. No. 3,765,297; Anderson U.S. Pat. No. 3,977,326; Horn U.S. Pat. No. 3,688,699; Dittrich U.S. Patent Publications 2007/0214992 and 2008091245, and Neugebauer U.S. Patent Publication 2014/0224144. Based on the absence from the marketplace for most if not all of the foregoing kinds of casings and cartridges, it would appear further improvements are needed.

There is always a desire for a lower cost cartridge, particularly for small arms cartridges that are used in large quantities. And there is always a continuing desire to improve the performance of cartridges. For example, for any particular caliber of cartridge it is generally desirable to maximize the volume within which gunpowder is contained. It is desirable for economic and environmental reasons to gather up spent casings that are expelled from a gun after firing. When the casings are made of brass or plastic that basically means using visual or optical means. Another need is to differentiate cartridges which have the same external appearance, as for example, same-size cartridges having different loadings of gunpowder. The differentiation should be done in an economic and durable way, compared for example to applying ink or paint.

SUMMARY

An object of the invention is to provide a cartridge use in a firearm, which is improved with respect to being light in weight and economic to manufacture, corrosion resistant, resistant to damage in handling, accommodative of primers currently in use, and suited for re-loading after use. A further object is to have a cartridge comprised of a casing which is attracted by a magnet to enable improvement in such gathering of spent casings. An object of the present invention is to make a lower cost cartridge, particularly for small arms, which is equal or better than prior art cartridges.

In embodiments of the invention, a cartridge for a firearm comprises a casing. In one embodiment, a casing comprises a sleeve which is secured to a base by means of a hollow nipple that extends from a bulkhead at one end of the sleeve and that is fastened in a passageway through the base. The opposing lengthwise end of the sleeve is cylindrical and comprises a mouth for holding a bullet or other closure. A recess in the passageway receives a primer. The bulkhead of the sleeve contacts or is intimately disposed at the first surface of the base. The terminal end of the nipple flares as a lip that sealingly engages a shoulder of the recess. In a casing embodiment there are two seals within the passageway, along the length of the nipple, one near the bulkhead and one at the lip/shoulder; and the seals are spaced apart by a tapered cylindrical void space around the nipple.

In another embodiment of the invention, the terminal end of the nipple which comprises a lip has, in casing lengthwise cross section, a special shape: (a) a first side of the lip is in contact with the shoulder, which is preferably runs at 90 degrees to the casing length; and (b) a second side (that faces the primer) is contoured and thinner at the lip outer rim than nearer the passageway (flash hole) through the nipple. The second side of the lip is contacted by the feet of the anvil of the primer in an advantageous way and enables an increased diameter of flash hole.

In other embodiments of the invention, the bulkhead has one or more depressions on the side which mates with the end of the base, preferably there is one or more circular waves or ridges centered on the lengthwise axis and the nipple. The wave creates a depression or hollow, and thus a space between the bulkhead and the surface of the base when the bulkhead is in contact therewith; and the wave creates a raised region in the gunpowder-holding concavity of the sleeve. The bulkhead is un-restrained by the surface of the base; i.e. there is no interlock or fastener other than by means of the nipple. Thus, the wave enables the bulkhead to expand radially during the pressure transient associated with firing a bullet, so the outer surface of the sleeve can contact the bore of the chamber and so that there are lesser stresses than would otherwise be present, to cause premature failure. A casing embodiment has a base with a surface having the same diameter as the bulkhead that abuts it, and the cannelure is spaced apart from said base surface, also to lessen stresses and enable a thin wall in the sleeve.

In another embodiment, the casing is made of an austenitic stainless steel having the special character of becoming magnetic when cold-worked. The sleeve has a cylindrical mouth wall portion of a first hardness and a first permeability, a bulkhead with a lesser hardness and permeability, and a nipple with a still lesser hardness and permeability. Thus the lip which holds the sleeve fixed to the base can be more easily formed. The cylindrical part of the casing will be drawn to a magnet, sufficient thereby to facilitate retrieval of spent casings. And the base is preferably made of an aluminum alloy which has a hardness that is less than any part of the sleeve.

Different combinations of the foregoing embodiments are useful. The present invention also comprises the method of making a casing and a cartridge which have the desired features described above.

A cartridge having a casing of the present invention fulfills the objects of the invention. The casing is stronger than the prior art brass cartridge casings for which it is substitutional. A casing has increased volume that enables use of slower burning powder. A casing is exceptionally durable and resists fatigue failure. It can be reloaded and fired many more times than a conventional cartridge. The foregoing and other features and advantages will be fully appreciated from the more detail description which follows and associated drawings.

This application claims benefit of provisional patent application Ser. No. 62/197,472 filed Jul. 25, 2015 and provisional application Ser. No. 62/387,418 filed Dec. 24, 2015, the disclosures of which are hereby incorporated by reference.

Figure 1:
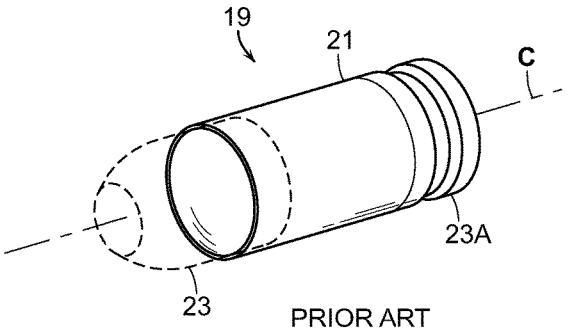
PRIOR ART FIG. 1
FIG. 1 is a perspective view of a typical prior art cartridge with the bullet shown in phantom.

FIG. 1 is a perspective view of a prior art casing 19 having a central length axis C; the casing comprises a cylindrical sleeve like portion 21 which is most often integral with base 23. Sleeve 21 has an open end or mouth 33. A bullet 23, shown in phantom, is frictionally held at the mouth 52 of the sleeve after propellant is put within the interior cavity of the casing. In a conventional 9 mm cartridge the bullet will set about 0.19 inches (4.8 mm) deep within the end of the sleeve.

Figure 2:
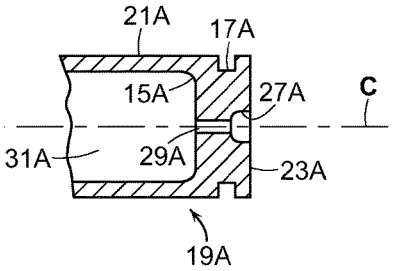
PRIOR ART FIG. 2
FIG. 2 is a partial cross section of the base end of a prior art casing.

FIG. 2 is a partial lengthwise cross section through the bottom end of a casing 19A, like those casings which are familiarly made from brass. Base portion 23A has a cylindrical recess 27A at the end, which is shaped to receive a primer that is press-fitted. Passageway 29A, often called the flash hole or vent, runs between the recess 27A and the interior concavity 31A of the sleeve of the casing. The portion 21A of casing 19A has a cylindrical outside surface wall that increases in thickness with distance from the mouth and with proximity to the base portion 23A. Such change in thickness is usually attributable to limitations of the fabrication process used; it also may be required for provide increased wall strength proximate the base portion, for resisting deformation or failure due to the high pressure generated inside the casing during firing of a bullet. Similarly, there is a rounded interior corner 15A where the cylindrical portion meets the base. Other projectiles and closures may be used for containing gunpowder in casings, for instance wadding may be used in a so-called blank round. In this description any closure of the casing shall be within the scope of the term "bullet."

Figure 3:
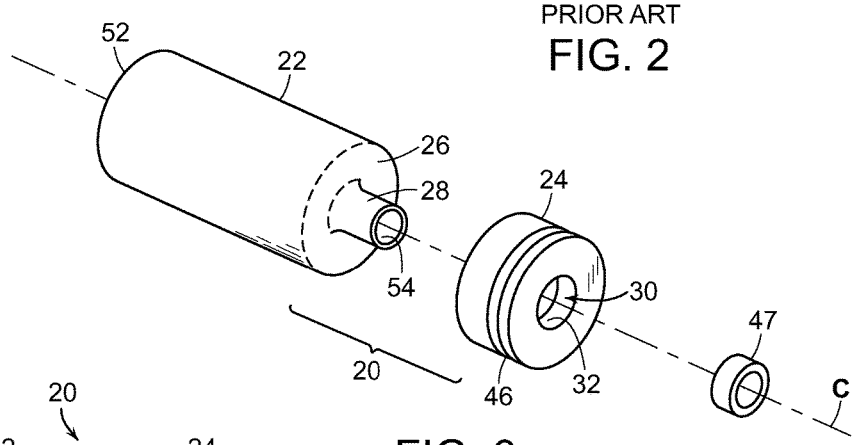
FIG. 3 is an exploded view of a casing of the present invention along with a primer.

FIG. 3 is an exploded view of an embodiment of casing 20 of the present invention, in combination with a primer 47. The casing is comprised of two mated pieces: sleeve 22 and base 24 centered on lengthwise axis C. Passageway 30 runs through the base to receive the nipple 28 of the sleeve. At the distal end of the base the passageway has larger diameter, namely recess 32, to receive cylindrical primer 47 with a press-fit. Base 24 has a cannelure 46, also called an extraction groove.

Figure 4:
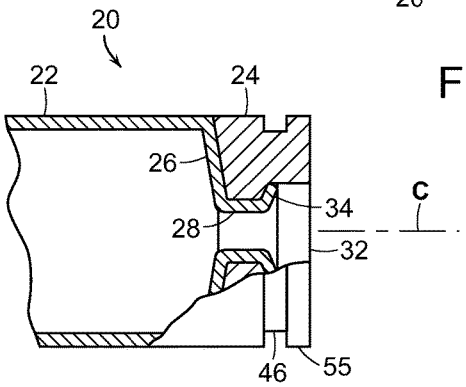
FIG. 4 is a cross section through an embodiment of the casing shown in FIG. 3.

FIG. 4 is a partial cutaway lengthwise view of an assembled casing 20 comprised of sleeve 22 which has been secured to base 24 by deformation of nipple 28 of the sleeve. Referring to both FIG. 3 and FIG. 4, before being mated with the base, sleeve 22 has an elongated cylindrical portion and a first end 52, shaped for receiving and holding a bullet. End 52 is often called the mouth of the casing. At the opposing end of the sleeve, nipple 28 extends from inward-running bulkhead 26. As formed before mating with the base, nipple 28 has an open end 54. When the two parts 22, 24 are mated, so the nipple is within passageway 30, the open end of the nipple is flared outwardly to form lip 34 thereby to hold the sleeve to the base.

Some aspects of the present invention relate to the mechanical configurations of the casing and its components, where the materials do not necessarily have a desirable unique combination of properties. The mechanical configurations of invention embodiments include how the sleeve and base are each shaped and how they mate with each other. In brief: A sleeve has a nearly constant thickness cylindrical wall portion, a bulkhead portion which optionally has a wave (annular ridge), and the terminal end of the nipple flares outwardly within the base to form a lip, thereby holding the sleeve to the base. The lip has a surface shape that is suited to support the primer. The invention casing has superior interior volume compared to prior art casings of the same exterior size.

While cartridges and casings having the foregoing features can be made using various materials, embodiments of the present invention involve materials with special properties and combinations of properties. In brief: Embodiments of the present invention comprise a sleeve which is made of an austenitic stainless steel that is hardened and magnetic, and the base is made of a softer metal, such as aluminum base alloy.

The mechanical aspects of the invention are concentrated on first in the following description. A casing of the present invention may be made of different materials and combinations of materials. Preferably, as discussed in greater detail below, a sleeve is made of austenitic stainless steel having a martensitic microstructure and the base is a wrought aluminum alloy.

Figure 5:
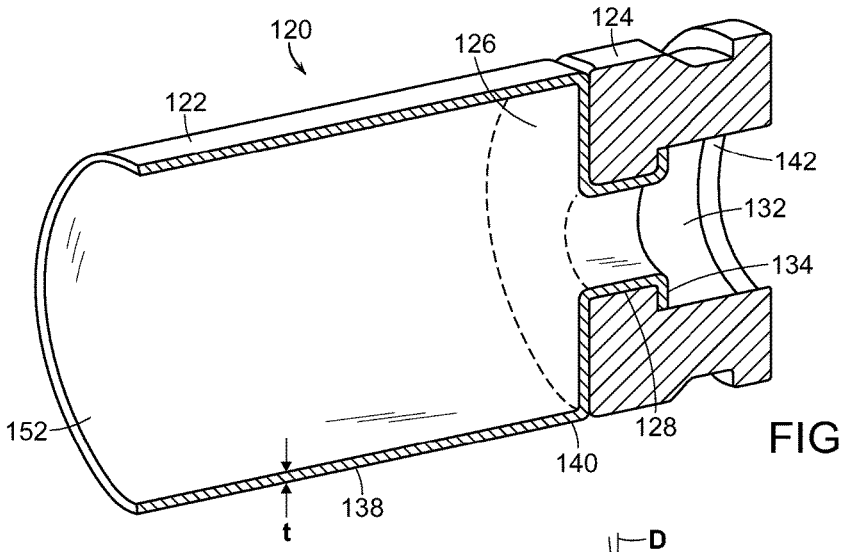
FIG. 5 is a lengthwise cross section through a casing.
Figure 6:
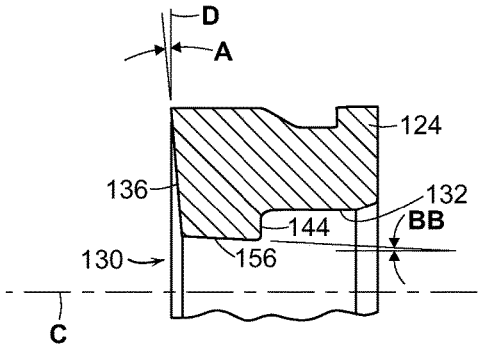
FIG. 6 is a more detail cross section view of the base shown in FIG. 5.
Figure 7:
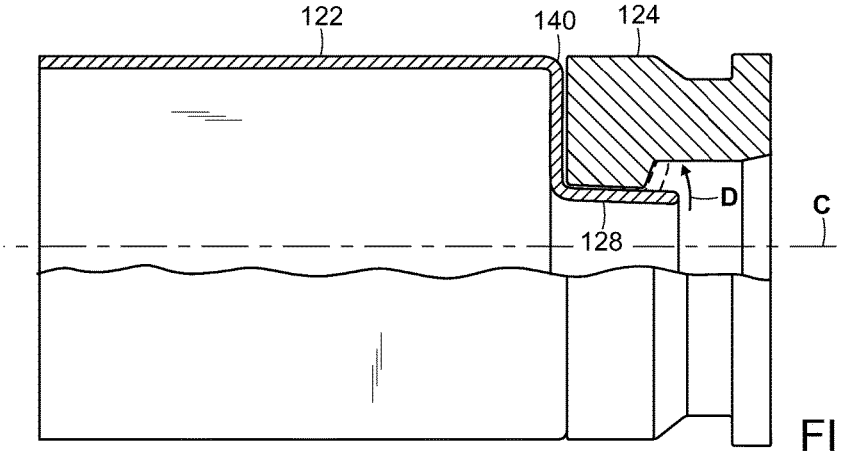
FIG. 7 is a partial lengthwise cross section through the casing of FIG. 5, showing how the sleeve is secured to the base.

FIG. 5 shows casing 120, comprised of a sleeve 122 and base 124, centered on lengthwise axis C. Sleeve 122 has an open end 152 for receiving a bullet, a cylindrical wall 138 having thickness t, and a bulkhead 126 which largely closes off the end of the sleeve which is proximate the surface of the base. Reference is also made to FIG. 6 and FIG. 7. Elements in different embodiments which have a number that shares the last two digits with another element number are same name and substantially same-function elements.

With reference to the partial cross section of base 124 in FIG. 6, the base has a circumferential land, or shoulder 144 where recess 132 of passageway 130 transitions to passageway 156. The surface of shoulder 144 is preferably perpendicular to the length axis C, optionally, inclined. The engagement of lip 134 with shoulder 144 helps hold the sleeve to the base and the lip forms a seal with the shoulder, to prevent or inhibit flow of from the primer region into whatever space there is between the exterior of the nipple and the bore of passageway 156.

Figure 7A:
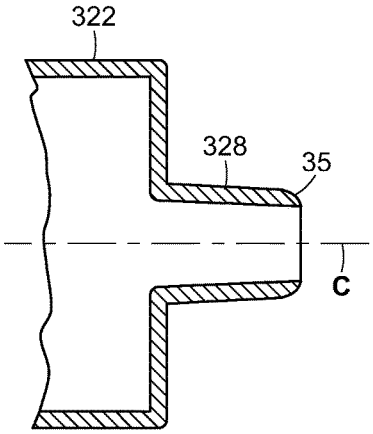
FIG. 7A is a partial lengthwise cross section of a sleeve showing a chamfer at the tip of a nipple.
Figure 7B:
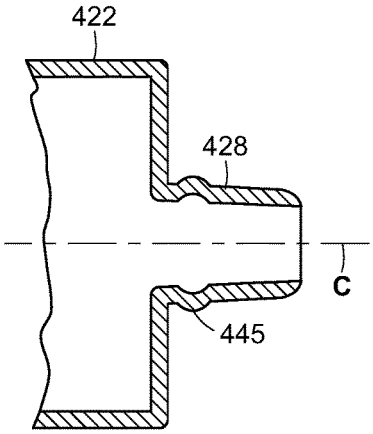
FIG. 7B is a view like FIG. 7A, showing an alternate embodiment sleeve.

During manufacturing of a casing, sleeve nipple 128 is placed into passageway 130 of the base and is flared radially outwardly to engage shoulder 144, as indicated by the phantom and arrow D in FIG. 7, to form lip 134. Preferably, as shown in FIG. 7A, the tip of the nipple is heavily chamfered prior to insertion of the nipple into the passageway of a base. Alternatively, the tip may be thinned by chamfering within the bore of the nipple. The chamfering and forming processes result in a lip that decreases in thickness in the outward direction, i.e., with radial distance from the centerline C. See FIG. 7C. FIG. 7D and FIG. 7E are detail cross sections showing the lengthwise cross sections of a portion of the nipple and the shape of lip embodiments. Lip 34 has a surface which is continuously curved. Lip 434 has a surface which has curved inner and outer portions and a flat on the surface 277.

In the invention, when the sleeve is viewed in lengthwise cross section, a preferred lip has a curved surface portion on the lip surface that faces in the direction of the end of the base which has the recess for a primer. The opposing side sealingly sets on a shoulder in the passageway of the base. Restated, a preferred sleeve has a lip that is thinner at the lip rim or outer edge than at the place where the nipple commences to run down the passageway of the base in combination with a surface which is wholly or partially curved. An advantage of the thinner outer edge and the curved second surface will be appreciated below in the description related to FIG. 15.

A preferred sleeve comprises a nipple which is particularly amenable to being flared with the desired shape and sealing effect. The chamfering of the nipple tip or terminal end and the stretching during flaring achieve the desired configuration. As described below, an effective seal is also a result of choice of preferred material and fabricating process, which result in differential properties along the length of the nipple within a base. In particular, preferably the tip of the nipple is softer than the rest of the sleeve, which has a desired combination of high hardness, high strength, and magnetic character.

Figure 14:
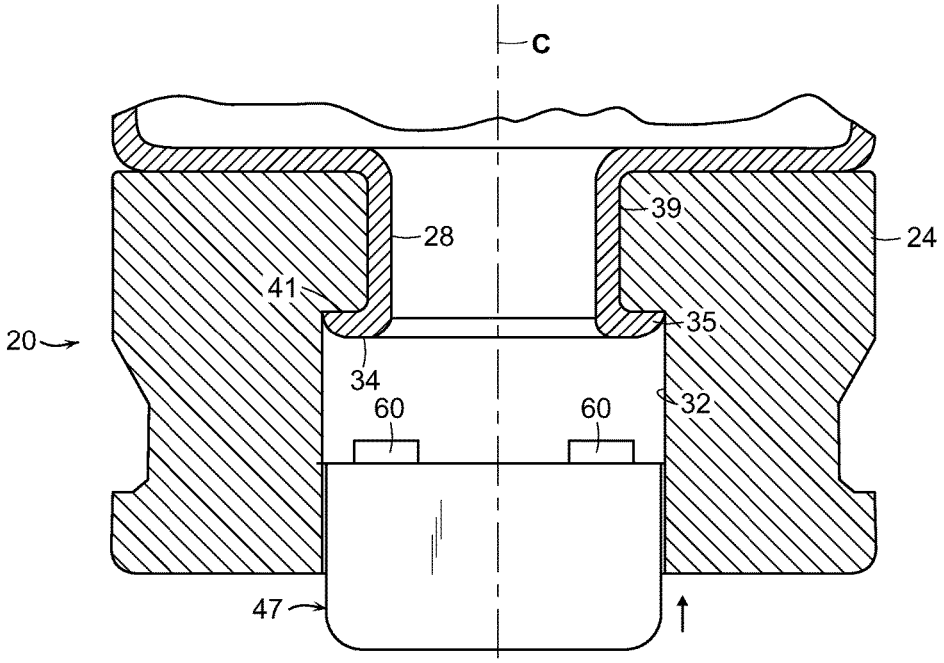
FIG. 14 is partial cross section of a base of a casing showing how a primer is press fitted into the recess of the base.
Figure 15:
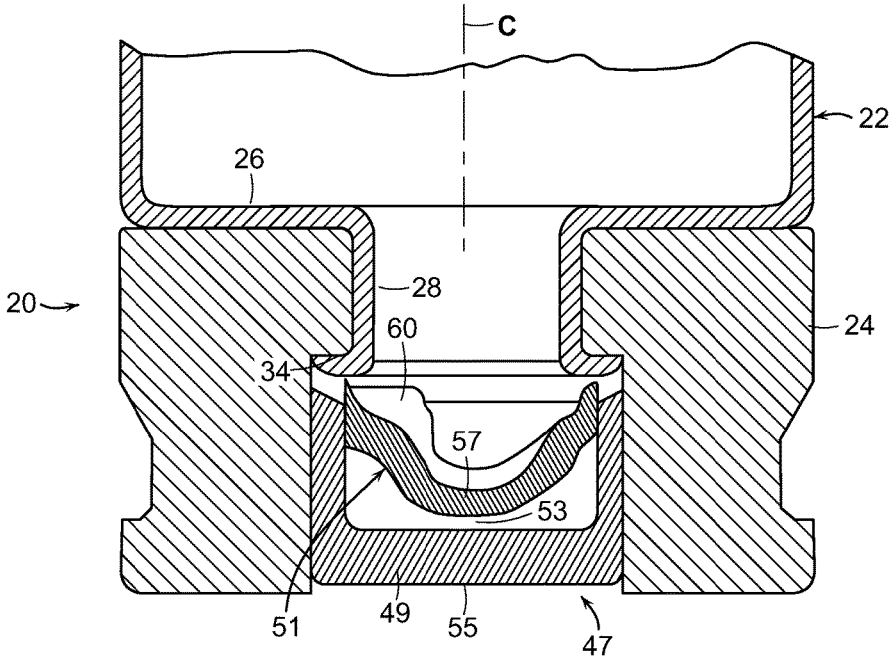
FIG. 15 is a view like FIG. 14 showing a primer inserted into the recess of a base.

As described below in connection with FIG. 14 and FIG. 15, in a subsequent manufacturing step, a primer is press fitted into recess 132, which has a chamfer 142 to ease such placement. The primer has an internal anvil, the feet of which rest on the lip of the sleeve.

While the shoulder onto which the lip is flared is preferably at 90 degrees to the length axis of the base and casing, in alternative embodiments the shoulder be frusto-conical shaped. In such instance, a thin-rim lip may present as a surface that is 90 degrees to the length axis. In a further alternate embodiment of the invention, the lip has a substantially constant thickness. To carry out this embodiment, when first formed, the nipple may have little or no chamfer at its terminal end, and during the flaring or lip-forming process the material at the end of the nipple is gathered and otherwise worked appropriately by one or more forming tools.

In an embodiment of the invention, a nipple may slip into the passageway 156 and there is only a first seal associated with lip 134. Preferably, there is a second seal between the nipple and the base within the bore of passageway 156, more preferably in proximity to the bulkhead.

Figure 7C:
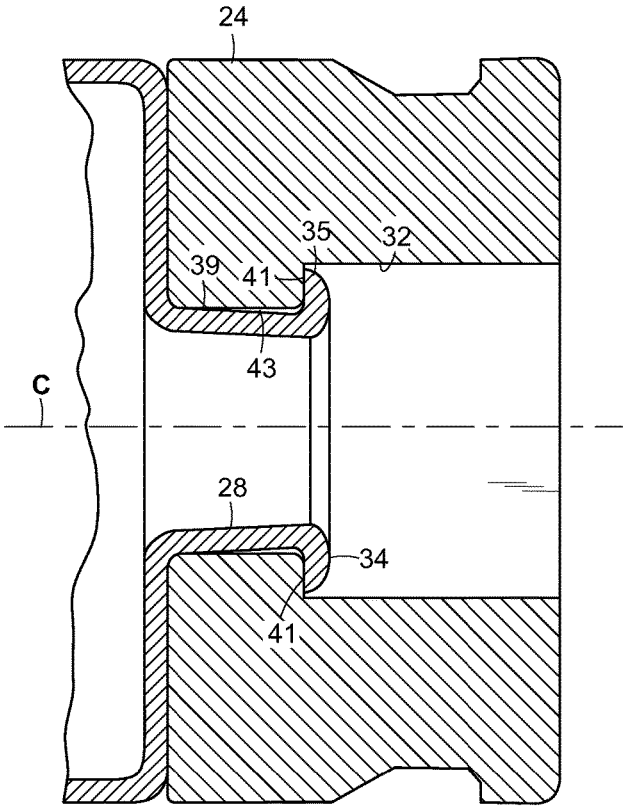
FIG. 7C is a partial lengthwise cross section of a sleeve within a base, showing the seal regions.
Figure 7D:
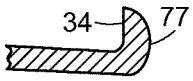
FIG. 7D is a lengthwise cross section of a portion of the lip of a nipple of a sleeve.
Figure 7E:
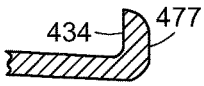
FIG. 7E is like FIG. 7D, showing an alternative configuration lip.

FIG. 7C shows a portion of a casing having the desirable first and second seals. The first seal 41 runs circularly between lip 34 and the shoulder of the base. The second seal at location 39 is substantially cylindrical. When a tapered nipple or a nipple relating to the nipple shown in FIG. 7B is pressed into the passageway, and the terminal end of the nipple is flared, the casing is characterized by a very thin void space 43, i.e., a region where there has not been a jamming of one surface into another. The space 43, which is exaggerated greatly in size for purpose of illustration circumscribes the nipple near the first seal, and tends to have the shape of a tapered-wall thin-wall-cylinder. Having a void 43 ensures that a good seal is achieved at location 39, and helps ensure that when pressed into the passageway of a base, the end of the nipple will be located correctly and can be appropriately formed, to make a lip 34.

In one way of constructing a casing having the two spaced apart seals, passageway 156 is of constant diameter and the exterior of the nipple is tapered. With reference to sleeve 222 in FIG. 9, the outside surface of nipple 228 tapers inwardly with distance from bulkhead 126, at angle B. Angle B is between 0 degrees and 10 degrees, preferably between 1 to 3 degrees. The diameter of the base of the nipple (nearest the bulkhead) is sized relative to the opening of passageway 156 at surface 136 so there is an interference or press fit of 0.002 to 0.005 inches (0.05 to 0.13 mm).

FIG. 7B shows alternative sleeve embodiment 422, which has a circumscribing ridge 445 on nipple 428, the aim of which is to enhance accomplishing the formation of the second seal 39. When inserted into the passageway, the ridge has an interference fit with the bore of the passageway. Nipple 428 may alternatively be tapered or substantially constant in outside diameter. In still other sleeve embodiments, the nipple may have step-changes in diameter along the nipple length.

In another embodiment of casing, passageway 156 tapers at angle BB as shown in FIG. 6, so the bore diameter is greater near surface 136 of the base. The nipple used with a base having such a passageway may be substantially constant diameter or may be tapered at the same angle or at a lesser angle than angle BB. In this embodiment, the second seal will be formed by press-fit at a location that is spaced apart from the surface 136 and may be proximate the lip seal.

As mentioned above, in another embodiment of casing where there is no second seal, the relative shapes of the nipple exterior and the bore of passageway 156 may be such that there is no press fit along the length of the nipple, and only the lip at the terminal end. In any of the embodiments, optional use may be made of an organic or inorganic sealant around the nipple or at the lip location.

Figure 11:
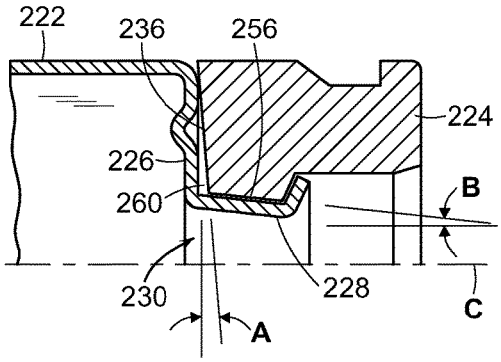
FIG. 11 is a partial cross section of a base and the adjacent sleeve, showing a space in vicinity of the nipple.
Figure 12A:
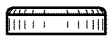
FIG. 12A shows in side view a first stage in progressive formation of a sleeve of a casing.
Figure 12B:
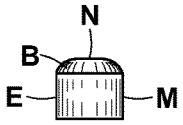
FIG. 12B is like FIG. 12A, showing a second stage.
Figure 12C:
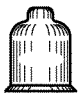
FIG. 12C is like FIG. 12A, showing a third stage.
Figure 12D:
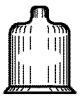
FIG. 12D is like FIG. 12A, showing a fourth stage.
Figure 12E:
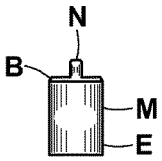
FIG. 12E is like FIG. 12A, showing a fifth stage.

The bore of a nipple may be straight or tapered; preferably the nipple has a wall thickness that is approximately the same as the thickness of the cylindrical section of the sleeve. As shown in FIG. 7 and FIG. 11 the bore of a nipple—which is the flash hole of the casing, increases in diameter with proximity to the bulkhead and the concavity of the sleeve, i.e., in accord with angle B in FIG. 9 where B is between 1 and 5 degrees. Such conical shape is through to enhance the manner in which hot gases from the primer are delivered to the gunpowder.

Referring again to FIG. 5 through FIG. 8, the bulkhead of sleeve 120 contacts, or is in close proximity to, the surface 136 of the base. Base surface 136 may be planar and perpendicular to length axis C of the casing and base. Alternatively, surface 136 may be dished so it is depressed near the center, with an incline angle A to plane D (which is a plane that is orthogonal to axis C) of between 0 and 5 degrees, preferably about 3 degrees. See FIG. 6.

The outside diameter of the base where it abuts the bulkhead is the same diameter as the diameter of the straight cylindrical portion of the sleeve, in preferred embodiments When that is not the case, there will be circumferential space between the exterior of the base and the chamber of the gun; and the outer "edge" or "corner" of the sleeve, namely region 140, 240 can preferentially or prematurely fail to tensile or bending overload or fatigue failure. That is attributed to lack of support at region 140, 240 with respect to deforming into the circumferential space. A preferred casing of the present invention comprises a base having a face (e.g., surface 236) which is the same diameter of the sleeve bulkhead and its integral cylindrical wall (e.g., wall 138). Thus, a casing embodying has a cannelure (extraction groove) which is spaced apart axially from the bulkhead; i.e., it is a circumscribing channel in the base. That kind of construction compares with a casing which has a reduced diameter adjacent the bulkhead, to define the extraction groove.

To carry out the purpose just mentioned, and for appearance reasons, there ought to be a minimum gap between the edge or corner 140, 240 and the bulkhead, surface 136. One way of helping to achieve that circumstance is to have an angle A as shown in FIG. 11, between the surface 236 of the base and the mating surface of the bulkhead 226. In the FIG. 11 embodiment, surface of the base is dished at angle A and the surface of adjacent bulkhead lies in plane D which is orthogonal to the central axis C. Thus, the bulkhead is said to be radially angled relative to the surface of the end of the base. That results in a small space 260 between the bulkhead and the surface 236 of the base 224, adjacent the passageway 230.

When a casing of the present invention is fitted with propellant and a bullet and inserted into the chamber of a firearm, it should slip fit into the chamber. For example, the clearance may be a few thousandths of an inch on each side of a typical cartridge having an about 0.386 inch (9.8 mm) outside diameter. During firing of the bullet there is great internal pressure rise which forces the cylindrical wall radially outward against the chamber of the gun. In embodiments of the invention, the casing will elastically deform radially outwardly during the deflagration of the propellant, then elastically to return to near its original dimensions, sufficient to enable easy removal of the spent casing from the chamber of the firearm. However, when there is outward expansion, excess stresses can be created at the circumferential location 140 where the sleeve bulkhead meets the cylindrical wall. It has been discovered through analysis and experiment that a propensity for failure at location 140 is mitigated by either or both (a) making the radius of curvature at location 140 sufficiently small; and (b) providing a circular wave 250, or ridge, on the bulkhead.

With respect to the radius: For a sleeve embodiment having a wall thickness of about 0.012 inch (about 0.3 mm), the mean radius of curvature at location 140 is preferably less than about 0.12 inches (32 mm); more preferably less than about 0.05 inches (1.27 mm). Larger radii make a casing more prone to failure. Still more preferably the radius is about 0.008 inches (0.2 mm) as measured at the inside surface, about 0.020 inches (2 mm) as measured at the outside surface, with a mean radius of about 0.014 inches (0.36 mm). In another preferred embodiment the mean radius is less than about two times the thickness of the material.

Figure 8:
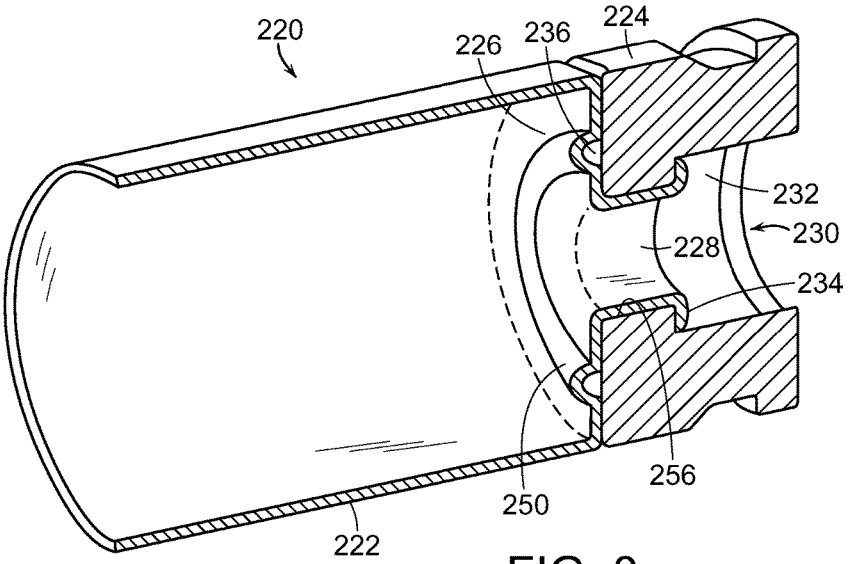
FIG. 8 is a lengthwise cross section through a casing with a sleeve having a circumferential wave around the bulkhead
Figure 9:
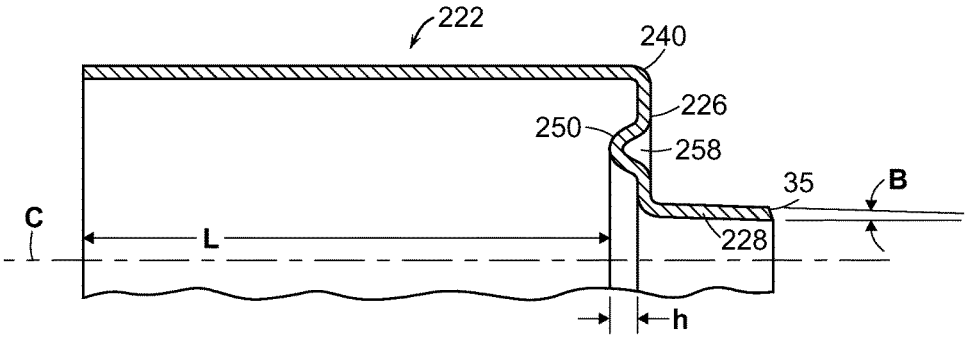
FIG. 9 is a lengthwise cross section of a sleeve having one wave in the bulkhead.

FIG. 8 is a view of casing 220 mated with base 224. Nipple 228 runs lengthwise within the smaller diameter passageway portion 256 of passageway 230 of base 224. The bulkhead 226 of the casing comprises a circular ridge, called a wave here. FIG. 9 is a partial lengthwise cross section of sleeve 222 before it is locked together with the base 224. The Figures show a sleeve 222 and base 224 which are like those of the casing 120, but for the presence of a wave 250 in the bulkhead 226. The circular or annular wave 250 is centered on the length axis C and the nipple length. When viewed in lengthwise cross section as in FIG. 9, wave 250 gives the bulkhead an irregular contour as it runs radially.

A preferred bulkhead has a wave that (a) creates a depression on the exterior side of the bulkhead (that facing the base) and (b) is not restrained by engagement with the abutting surface of the base. The wave defines an annular depression or hollow 258 on the exterior surface of the bulkhead. The bulkhead is preferably of constant thickness and is in contact with or in very close or intimate proximity to the surface 236 at the end of the base; and the wave defines a void space between the bulkhead and the surface 236. When propellant is deflagrated within the casing, the presence of a wave lowers the von Mises stresses at region 240, where the cylindrical sidewall of the sleeve meets the bulkhead. It is believed that the high gas pressure within the casing when gunpowder is ignited causes the wave to elastically deform, or flatten. That allows both the outside circumferences of the bulkhead and the adjacent sleeve cylindrical portion at location 240 to increase—to the point that they contact the bore of the chamber within which the cartridge is positioned, thereby to make momentarily a seal that inhibits flow of gun barrel gases between the casing and the chamber bore. In the invention, there is no ridge or engagement feature on the base surface, and the bulkhead is able to move radially relative to the surface 236. Preferably the aforementioned small radius of curvature is present at region 240 in combination with a wave.

The void space which the wave creates between the bulkhead and the abutting surface 236 of the end of the base is in addition to whatever small void space may be present in the region because of any difference in angling between the bulkhead and the abutting surface of the base.

In an example of the invention where the sleeve has a wave, the diameter of a 0.010-0.012 inch (0.25-0.30 mm) thick cylindrical wall of a sleeve is about 0.39 inches (9.9 mm) in diameter, a wave 250 will have a mean diameter of about 0.23 inches (5.8 mm) and will project a dimension h of about 0.002 to 0.050 inches (0.05 to 1.27 mm), more preferably about 0.002-0.010 inches (0.051-0.25 mm) from the mean interior surface of the bulkhead. The projection h may be referred to as the height of the wave.

Figure 10:
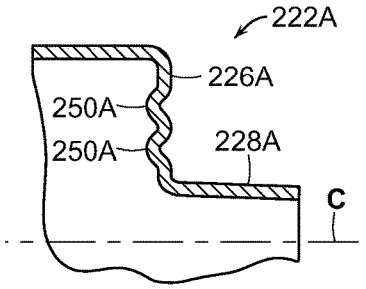
FIG. 10 is a partial lengthwise cross section of a sleeve having two waves in the bulkhead.
Figure 10A:
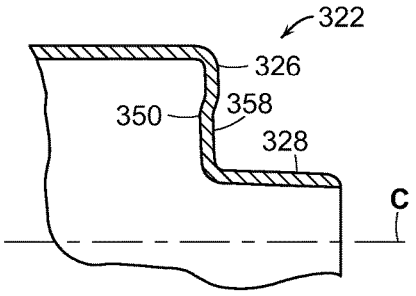
FIG. 10A is lengthwise cross section of a sleeve having an alternative wave.

FIG. 10 shows a portion of a sleeve 222A, which has two waves. Two waves 250A run circularly on bulkhead 226A, circumscribing the length axis C of nipple 228A. FIG. 10A shows a portion of another sleeve 322 having a nipple 328 and bulkhead 326, where there is still another embodiment of wave. In cross section, the depression 358 that is provided by wave 350 starts at the nipple and runs outwardly to a point where the bulkhead surface becomes closer to the abutting surface of the base (not shown in FIG. 10A).

To summarize, in the generality of this aspect of the invention, a casing has a bulkhead with one or more depressions on the surface facing the base. Other bulkhead configurations may achieve the object of this aspect of the invention, a first bulkhead surface of said wave projects or protrudes into the concavity of the sleeve, and the second opposing side surface of the bulkhead has an associated depression or hollow.

Figure 13:
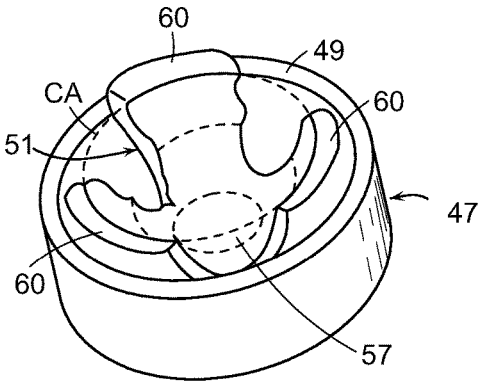
PRIOR ART FIG. 13
FIG. 13 is a perspective view of a primer known in the prior art.

FIG. 13 is a perspective view of a familiar primer 47 comprising cap 49 having an anvil 51 within its concavity. Anvil 51 has a head 57 three feet 60. There is a circumference CA, shown as a dashed circle, which defines the inner bounds of the feet 60. FIG. 14 shows primer 47 being inserted into the recess 32 of base 24 of casing 20, as indicated by the arrow in the Figure. FIG. 15 shows the cap fully positioned within the recess of the base of the casing. As described above, in a prior manufacturing step the end of nipple 28 of sleeve 22 has been flared outwardly so the resultant lip 34 presents a curved annular surface at the bottom of recess 32. When the primer is fully inserted and when the primer is struck by a firing pin, the feet 60 of the anvil contact the surface of the lip.

The outer edge or rim 35 of lip 34 is thinner than the rest of the lip, as discussed in connection with FIG. 7C, 7D, and 7E. With reference to FIG. 15, there is a space 53 between head 57 of the anvil and the interior wall of the cap 49, where a quantity of impact-detonating substance (not shown) is placed by the primer manufacturer. When a firing pin of a firearm deforms surface 55 of the cap in the direction of the head 57 of anvil 51, it causes the primer substance to detonate. The anvil feet are supported by lip 34. In response to the applied force, there is a tendency for the anvil feet (also called "legs") to thrust outwardly relative to centerline C of the casing. Sectioning of fired cartridges indicates that the feet of many anvils are thrust outwardly to an extent during the firing process. The curved surface of the lip is believed to enhance support for the feet of the anvil.

Figure 16:
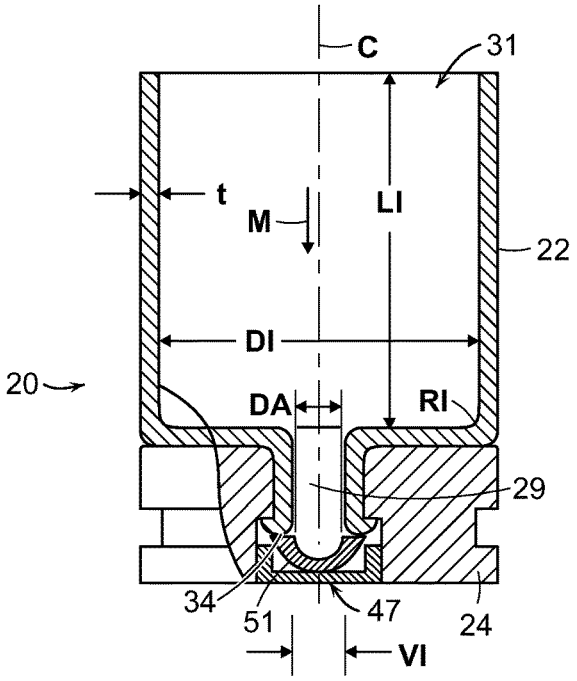
FIG. 16 is a lengthwise cross section of a casing of the present invention.
Figure 17:
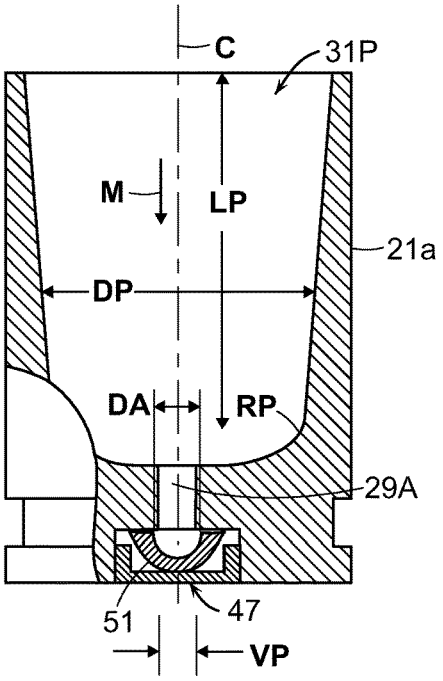
PRIOR ART FIG. 17
FIG. 17 is a lengthwise cross section of a prior art casing.

For a given external shape cartridge, the present invention can provide a larger diameter flash hole larger volume casing, compared to a same exterior shape prior art one piece cartridge. FIG. 16 and FIG. 17 compare the internal configurations of casing 20, made in accord with the present invention and a prior art one piece brass casing 21, each having the same respective length LI, LP of interior cavity.

The invention enables an increased diameter VI of the flash hole 29 in casing 20, compared to diameter VP of flash hole 29A in prior art casing 21, aided by the shape of lip 34 which in providing good support for the feet of the anvil of a primer, enables a smaller width of land at the bottom of the recess 32.

Casing 20 has a flash hole 29 which has increased diameter VI, compared to diameter VP of flash hole 29A in prior art casing 21. The increased diameter is achieved with the aid of the shape of lip 34, which in providing good support for the feet of the anvil of a primer, enables a smaller width of land at the bottom of the recess 32. The flash hole of sleeve 22 is larger in diameter than the diameter DA of the innermost bounds of the anvil fee. Diameter DA is the diameter of a circle CA which touches the innermost portions of the feet 60 of an anvil 51 of a primer. See FIG. 13. In a preferred casing 22 portions of feet 60 are visible to the eye when looking with appropriate magnification along the center axis C, as indicated by the arrow M in FIG. 16. In comparison, only the head of the anvil, and not the edges of the feet, are visible in an exemplary prior art cartridge when viewed in the same way, as portrayed in FIG. 17. An increased diameter flash hole provides improved communication of the hot gases from the primer region, into the concavity 31 of sleeve 22; that aids more favorable deflagration of the gunpowder within the concavity.

Since steels having a higher strength than cartridge brass may be used in a casing of the present invention, thinner casing walls are useful. An exemplary casing of the invention has a nearly uniform wall thickness t of about 0.010 to 0.012 inches (0.25 to 0.3 mm). That is about 0.0.15 inches (0.381 mm) less than the average 0.027 inch (0.59 mm) wall thickness of an exemplary prior art casing 21. Thus the average internal diameter D1 of casing 20 is larger than the average diameter DP of casing 21; and, there may be an about 4 to 15 percent more volume within the casing, for the powder characteristic of an assembled cartridge. Typically a cartridge maker uses a gunpowder which fills the concavity 31, 31P of the casing, when the bullet is in place. In general, to achieve certain desirable pressure vs. time change within the barrel of a gun that enhances bullet velocity and repeatability, it is desirable to have larger volume of reduced burn rate powder, compared to having a smaller volume of high burn rate powder. The present invention enables that desirable result. Tests have shown a higher repeatability in bullet velocity at the exit of the barrel of a gun, and that results in more accurate targeting of the bullet.

In the generality of the invention which involves the foregoing mechanical features, a sleeve may be made of iron alloys (e.g., steels) and preferably other alloys having iron, aluminum, and copper base. As noted just above, the best performance of an invention casing/cartridge is achieved when the material of the sleeve has high strength.

Preferably, an exemplary sleeve of a casing of the present invention is made of a kind of austenitic stainless steel which is cold worked sufficient to form a martensitic microstructure, to thereby selectively both harden and make magnetic the steel, compared to the same steel in its annealed condition. A preferred material for the base is 7075 wrought aluminum alloy in T6 temper.

A preferred austenitic stainless steel is AISI 304 stainless steel alloy. Other alloys which preferentially may be used include AISI 302, AISI 308, and AISI 347. Casings of the foregoing and like-behaving alloys are used in the cold worked condition, without annealing. The select alloys have a desirable combination of formability, corrosion resistance, and strength. In their annealed condition the alloys are not magnetic; when cold worked during casing fabrication they are magnetic. For what "magnetic" means, see explanation below connected with Table 1. In the preferred materials, a deformation-induced martensite (a ferromagnetic phase) is present when the material is cold worked and not-annealed; and that makes the material advantageously attracted by a common magnet. Preferred alloys of the invention are in a special class. For example, the austenitic stainless steel, AISI 316, is not magnetic when a casing is cold-worked as described herein. For example, casings made of stainless steels of the AISI 400 series, the steel is ferritic and magnetic, regardless of working or presence of martensite.

When casings of the preferred material are discharged from an automatic or semi-automatic weapon and are scattered about on the ground, the used casings may be retrieved by sweeping an area with a permanent magnet or common electromagnet. Compare, brass, aluminum or non-metal casings.

Working of the AISI 304 alloy also hardens it and increases its ultimate strength, enabling a lighter wall thickness in the sleeve than when the alloy is not cold worked. Preferably, the AISI 304 sleeve material is at least "one-quarter hard", wherein it has a hardness of at least about Rockwell C ("Rc") 30 and an associated ultimate tensile strength of about 125,000 psi (pounds per square inch)($6\times10^6$ N/m$^2$). That compares with the Rockwell B 83-92 hardness and about 75,000 psi ($3.6\times10^6$ N/m$^2$) ultimate tensile strength of a common annealed wrought bar or strip of AISI 304 material. More preferably, AISI 304 material is worked so that the hardness is greater than about Rc 40 and the ultimate tensile strength is in excess of 150,000 psi ($7.2\times10^6$ N/m$^2$).

Preferably, the sleeve is formed in an eyelet machine (transfer press), starting with a flat disk of steel. The disk is sequentially worked to change shape as illustrated by the steps (a) to (e) in FIG. 12. The sleeve in its condition for insertion into the base of a casing is illustrated at step (e). Referring to the illustration at step (e) in FIG. 12, a typical sleeve of the present invention has a top/nipple location N, a bulkhead location B, a midpoint cylindrical section location M, and a mouth end location E, as illustrated in FIG. 12. Working backward through the forming steps, the corresponding locations in the intermediate shapes can be approximately identified.

Table 1 shows the magnetic properties at each stage and the hardness distribution at the final stage (e). It is seen that with progressive working, the permeability (loosely "the magnetization") increased, measured in Mu. Likewise, it is seen that hardness increased significantly at midpoint M and the mouth end E. The hardness in HVN (Vickers Hardness Number using a 200 gm load) is highest at the mouth end, being more than 400 HVN. As is well known, increased hardness is associated with increased yield/ultimate strength, and that property is desirable where the sleeve wall has higher stresses, namely at the cylindrical portion, compared to the nipple.

TABLE 1

Local magnetic and hardness properties of sleeve illustrated in FIG. 12.

| Parameter | Stage of formation | N-nipple | B-bulkhead | M-midpoint | E-open end |
|---|---|---|---|---|---|
| Permeability (Mu) | a-near-blank | <1.0 | 1.0-1.1 | | |
| | b | <1.0 | 1.0-1.1 | 1.5 | |
| | c | 1.0-1.1 | 1.0-1.1 | 1.8-2 | 2-3 |
| | d | 1.0-1.1 | 1.1-1.2 | 2-3 | 2-3 |
| | e-finished | 1.4-1.8 | 2-3 | 3-4 | 3-4 |
| Hardness (HVN) | e | 360-390 | 330-350 | 410-440 | 440-490 |

Preferably, the sleeve of an invention casing is an austenitic stainless steel having a permeability which is at least 2 Mu, more preferably at least 3 Mu. In this application, a steel having such at least 2 Mu property is said to be magnetic. Casings comprised of a sleeve in such magnetic condition can be attracted by a permanent magnet or electromagnet; that is quite useful for purposes of retrieving and/or handling used casings.

The degree of magnetism, namely permeability (more properly relative permeability), of a casing can be measured in Mu units in accord with standard ASTM A342-Method No. 6. Use may be made of a measuring device called The Severn Gage (Severn Engineering Co., Inc., Auburn, Ala., U.S.).

The cylindrical portion E of the sleeve, which extends to the mouth becomes most hard and correspondingly magnetic. The bulkhead also is strong and magnetic. In comparison, the nipple portion of the sleeve is desirably less worked and less hardened and that facilitates its press fit engagement with the base and its capturing within the base by means of a lip. The small diameter of the nipple means stresses for any given internal pressure are lower than in the cylindrical portion of the sleeve. Also, being small and buried within the base, a nipple would contribute little to attraction of a casing to a magnetic pickup tool. Since it is less hard, the nipple terminal end more amenable to being flared radially outwardly and the desired good sealing contact may be better achieved. Cold-working to make the flared lip increases hardness and permeability of the lip portion, but does not change the corresponding properties of the lengthwise nipple portion that runs toward the bulkhead from the lip within passageway 156, 256, in particular, that portion which is in vicinity of void 43 in FIG. 7C.

Thus an embodiment of casing and sleeve is a combination which comprises a sleeve having less permeability and hardness in the nipple where it runs from the lip and the shoulder of the primer recess to the bulkhead that does the sleeve have in at the bulkhead and mouth end.

The base may be formed by stamping, pressing, or machining, less preferably by casting. The base is preferably made of wrought aluminum alloy, preferably alloy wrought 7075 alloy in T6 temper condition. That alloy is of high strength, sufficient to hold the primer and sufficient to endure the forces of the manufacturing process during which the nipple is deformed. An aluminum base may be anodized and dyed for color coding, to demark different types of cartridges. Alternatively, an aluminum alloy base may be coated with electroless nickel phosphorous metal. An exemplary aluminum alloy base will have a Rockwell B hardness in the range 70 to 98. The base has strength sufficient to sustain deforming of the nipple and forces imposed by the breech block In a concept of the present invention, the sleeve cylindrical portion including the mouth has the highest strength and hardness, the bulk of the nipple with the passageway of the base has lesser strength and hardness, and the base has the lowest hardness. This combination is advantageous for reasons in part stated above, and further because the softer base lessens wear or decreased life of the firearm parts which grip and eject cartridges/casings, compared for instance to a steel base, or to a prior art steel casing.

In the generality of the invention, a base may alternatively be made of other metal, such as cartridge brass, other brasses, and cast zinc base alloys, which metals are less hard than the casing material. In still other embodiments of the invention, if aforementioned wear of gun parts is not a factor, steel alloys or ceramics may be used for the base.

The present invention includes a shell or cartridge which comprises a casing having the new features which are described herein. In particular, a shell is formed by pressing into place a primer in the recess of the base of casing, putting gunpowder into the concavity of the sleeve through the mouth end, and pressing and crimping a bullet into the mouth of the sleeve. Those steps can all be done using the same kind of equipment as has been used for making cartridges comprising prior art casings, e.g., brass casings. While the invention has been described in terms of a small caliber cartridge, the invention may be applied to larger caliber shells.

The present invention also includes the method of making a casing and a cartridge having the features described herein using the methods which have been described. A casing may be assembled from a sleeve and base by using automated machinery which mates the two pieces with each other and using (a) tooling that fits within the mouth of the sleeve and presses on the nipple and adjacent bulkhead while the base is being held, to force the nipple into the passageway of the base so the outer edge of the bulkhead is either in contact with the face of the base or intimately close; and using (b) tooling that fits within the primer recess and presses axially on the terminal end of the nipple to flare the end radially outwardly and form a lip which presses against the shoulder at the bottom of the recess, where the lip preferably has an annular curved surface. Thereafter, to form a cartridge, in step (c) a primer is pressed into the recess at the end of the base so the legs of the primer anvil contact or are very close to the surface of the lip; in step (d) gunpowder is put into the concavity of the sleeve; and in step (e) a bullet is pressed into the mouth of the sleeve and the mouth is preferably crimped onto the bullet.

The unique features of the sleeve and base provide the invention with surprising advantage. A casing/cartridge is provided with light weight, lower cost and higher performance than prior art casings. At the same time the casings/cartridges have durability during handling and the capability for reloading.

The invention, with explicit and implicit variations and advantages, has been described and illustrated with respect to several embodiments. Those embodiments should be considered illustrative and not restrictive. Any use of words which relate to the orientation of an article pictured in space are for facilitating comprehension and should not be limiting should an article be oriented differently. Any use of words such as "preferred" and variations thereof suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A casing for a firearm cartridge, comprising:

a sleeve made of metal and having a length and central length axis, the sleeve comprising a cylindrical wall portion running lengthwise from a first end to an opposing second end, the first end having a mouth shape for receiving a bullet, the second end comprising a circular bulkhead connected at a bulkhead outer edge to said cylindrical wall portion and running generally transverse to the sleeve length, the bulkhead having an exterior surface; the cylindrical wall and the bulkhead defining a concavity suited for receiving gunpowder propellant, the sleeve further comprising a nipple extending lengthwise from the bulkhead to a nipple terminal end, the nipple having a bore for enabling flow of propellant gases into said concavity;

a base made of metal and having a length, a central length axis, a first end, an opposing second end and, a passageway running lengthwise between the first end and the second end, the passageway comprising a recess at the first end of the base, the recess shaped for receiving a primer and defining a circumscribing shoulder within the passageway, the second end of the base having a surface shaped for mating with the bulkhead of the sleeve;

wherein said bulkhead exterior surface is in abutting contact with or in close proximity to said surface of the second end of the base, wherein the cylindrical wall portion of the sleeve and the base have substantially the same exterior circumference, and wherein said nipple is positioned within said passageway;

wherein the terminal end of the sleeve nipple comprises a lip running radially outwardly relative to the sleeve central length axis, the lip in contact with said circumscribing shoulder of the base passageway to form a first seal with the base, the lip having an annular surface that faces away from the base second end and is spaced apart from the base first end; and, wherein the nipple forms a second seal with the base within the passageway in proximity to the second end of the base, the second seal spaced apart from the first seal.

2. The casing of claim 1 having a void space around the circumference of the nipple at a location between the first seal and the second seal.

3. The casing of claim 1 wherein the lip has a rim which is, in the sleeve lengthwise direction, thinner than other portions of the lip which are in contact with said shoulder.

4. The casing of claim 3, wherein said annular surface of the lip is curved.

5. The casing of claim 3 further comprising: a primer comprising an anvil having feet, the primer press fitted into the recess at the first end of the base so the feet of the anvil either are in contact with or are very close to said lip annular surface.

6. The casing of claim 1 wherein the bulkhead has at least one wave, the wave defining a depression on said exterior surface of the bulkhead.

7. The casing of claim 1 wherein the bulkhead exterior surface is in circumferential contact with an outer portion of the second end of the base and wherein the exterior surface of the bulkhead adjacent the nipple is spaced apart from the surface of the second end of the base.

8. The casing of claim 1 wherein the sleeve is comprised of an austenitic stainless steel material, the sleeve having portions which are magnetic, the sleeve having differing hardness and differing degrees of magnetic permeability along the length thereof; wherein a sleeve cylindrical wall portion has higher hardness and higher magnetic permeability than a portion of the nipple which is between said lip and said bulkhead; and wherein said austenitic stainless steel material optionally is selected from the group comprising AISI 304 steel, AISI 302 steel, AISI 308 steel and AISI 347 steel.

9. A cartridge comprising: the casing of claim 1; a primer positioned within the recess at the end of the base; a quantity of gunpowder within the concavity of the sleeve of the casing; and, a bullet positioned within the mouth first end of the sleeve of the casing.

10. The casing of claim 1 wherein the base is made of a metal having a hardness that is less than the hardness of any portion of the sleeve, and wherein the base has a cannelure spaced apart from the second end.

11. A casing for a firearm cartridge, comprising:

a sleeve having a length, a central length axis, the sleeve comprising a cylindrical wall portion running lengthwise from a first end to an opposing second end, the first end having a mouth shape for receiving a bullet, the second end comprising a circular bulkhead connected at a bulkhead outer edge to said cylindrical wall portion and running generally transverse to the sleeve length, the bulkhead having an exterior surface; the cylindrical wall and the bulkhead defining a concavity suited for receiving gunpowder propellant, the sleeve further comprising a nipple extending lengthwise from the bulkhead to a nipple terminal end, the nipple having a bore for enabling flow of propellant gases into said concavity;

a base having a length, a central length axis, a first end, an opposing second end and a passageway running lengthwise between the first end and the second end, the passageway comprising a recess at the first end of the base, the recess shaped for receiving a primer and defining a circumscribing shoulder within the passageway, the second end of the base having a surface shaped for mating with the bulkhead of the sleeve;

wherein said bulkhead exterior surface is in abutting contact with or in close proximity to said surface of the second end of the base, wherein the cylindrical wall portion of the sleeve and the base have substantially the same exterior circumference, and wherein said nipple is positioned within said passageway; and, wherein the terminal end of the sleeve nipple comprises a lip running radially outwardly relative to the sleeve central length axis, the lip in contact with said circumscribing shoulder of the base passageway, the lip having a curved annular surface that faces away from the base second end and is spaced apart from the base first end.

12. The casing of claim 11 wherein the lip has a rim which is thinner than other portions of the lip which are in contact with said shoulder.

13. The casing of claim 12 further comprising: a primer comprising an anvil having feet, the primer positioned within said recess, wherein said feet are either in contact with or very close to said annular surface of the lip.

14. The casing of claim 11 wherein said lip forms a first seal with the shoulder of the recess within the passageway, wherein the bore of the passageway through the base has a constant diameter proximate the base second end, wherein a portion of the nipple proximate the bulkhead has an exterior surface, optionally tapered, in tight fit engagement with the bore of the passageway proximate the base second end to thereby form a second seal within the passageway.

15. The casing of claim 14 wherein the first seal and the second seal are spaced apart by a void space around the circumference of the nipple.

16. The casing of claim 11 wherein the bulkhead has at least one wave, the wave defining a depression on said exterior surface of the bulkhead.

17. The casing of claim 11 wherein a portion of the surface of the second end of the base adjacent the passageway is spaced apart from the adjacent exterior surface of the bulkhead, the spacing apart decreasing to zero with distance from the nipple in the radial outward direction.

18. The casing of claim 11 wherein the base is made of a metal having a hardness that is less than the hardness of any portion of the sleeve; wherein the base and the cylindrical portion of the sleeve have substantially the same exterior circumference; and, wherein the base has a cannelure spaced apart from the second end.

19. The casing of claim 11 wherein the sleeve is comprised of an austenitic stainless steel material, the sleeve having portions which are magnetic.

20. A firearm cartridge comprising: a casing of claim 11; a primer positioned within the recess at the end of the base; a quantity of gunpowder within the concavity of the sleeve of the casing; and, a bullet positioned within the mouth first end of the sleeve of the casing.

21. A casing for a firearm cartridge, comprising:

a sleeve having a length and a central length axis, the sleeve comprising a cylindrical wall portion running lengthwise from a first end to an opposing second end, the first end having a mouth shape for receiving a bullet, the second end comprising a circular bulkhead connected at a bulkhead outer edge to said cylindrical wall portion and running generally transverse to the sleeve length, the bulkhead having an exterior surface; the cylindrical wall and the bulkhead defining a concavity suited for receiving gunpowder propellant, the sleeve further comprising a nipple extending lengthwise from the bulkhead to a nipple terminal end, the nipple having a bore for enabling flow of propellant gases into said concavity;

a base having a length, a central length axis, a first end, an opposing second end and a passageway running lengthwise between the first end and the second end, the passageway comprising a recess at the first end of the base, the recess shaped for receiving a primer and defining a circumscribing shoulder within the passageway, the second end of the base having a surface shaped for mating with the bulkhead of the sleeve;

wherein said bulkhead exterior surface is in abutting contact with or in close proximity to said surface of the second end of the base, wherein the cylindrical wall portion of the sleeve and the base have substantially the same exterior circumference, and wherein said nipple is positioned within said passageway;

wherein the terminal end of the sleeve nipple comprises a lip running radially outwardly relative to the sleeve central length axis, the lip in contact with said circumscribing shoulder of the base passageway to form a first seal with the base, the lip having an annular surface that faces away from the base second end and is spaced apart from the base first end; and wherein the bulkhead has at least one wave, the at least one wave defining a depression on said bulkhead exterior surface and a corresponding raised region on the bulkhead within the concavity of the sleeve; and wherein the surface of the second end of the base and the exterior surface of the bulkhead are shaped for enabling radial direction motion relative to each other as a result of flattening of the wave when gunpowder contained within the concavity of the sleeve is detonated.

22. The casing of claim 21 comprising two or more of said at least one waves.

23. The casing of claim 21 wherein the surface of the second end of the base diverges in radial angle direction from bulkhead exterior surface, thereby providing an annular space adjacent the nipple between the bulkhead exterior surface and the base second end surface.

24. The casing of claim 21 wherein the sleeve is made of an austenitic stainless steel material that has a magnetic permeability which is at least 2 Mu, and the base is made of a metal alloy which is non-magnetic and has a hardness which is less than the hardness of said austenitic stainless steel material.

25. The casing of claim 24 wherein the sleeve mouth first end has higher hardness and higher magnetic permeability than the nipple portion of the sleeve which is between the lip and the bulkhead; and wherein the nipple is in sealing contact with the bore of the passageway at both the location of said lip and in proximity to the second end of the base.

26. The casing of claim 21 wherein said lip annular surface is curved and wherein said lip has a rim which is thinner in the sleeve lengthwise direction than are other portions of the lip which are in contact with said shoulder.

27. A firearm cartridge comprising: a casing of claim 21, a primer positioned within the recess at the end of the base; a quantity of gunpowder within the concavity of the sleeve of the casing; and, a bullet positioned within the mouth first end of the sleeve of the casing.

28. A casing for a firearms cartridge, comprising:

a sleeve having a length, a central length axis, the sleeve comprising a cylindrical wall portion running lengthwise from a first end to an opposing second end, the first end having a mouth shape for receiving a bullet, the second end comprising a circular bulkhead connected at a bulkhead outer edge to said cylindrical wall portion and running generally transverse to the sleeve length, the bulkhead having an exterior surface; the cylindrical wall and the bulkhead defining a concavity suited for receiving gunpowder propellant, the sleeve further comprising a nipple extending lengthwise from the bulkhead to a nipple terminal end, the nipple having a bore for enabling flow of propellant gases into said concavity; and, a base having a length and a lengthwise central axis, a first end, an opposing second end, and a passageway running lengthwise between the first end and the second end, the passageway having a recess at the first end of the base, the recess larger in diametrical dimension than the rest of the passageway, defining a circumscribing shoulder within the passageway, and shaped for receiving a primer; wherein said sleeve nipple is positioned within the passageway;

wherein the terminal end of the sleeve nipple comprises a lip running radially outwardly relative to the sleeve central length axis, the lip in contact with said circumscribing shoulder of the base passageway, the lip having an annular surface that faces away from the base second end and is spaced apart from the base first end; and, wherein the bulkhead exterior surface is in contact with an outer circumferential portion of the second end of the base and the exterior surface of the bulkhead adjacent the nipple is spaced apart from said surface of the second end of the base.

29. The casing of claim 28 wherein said lip forms a first seal with the shoulder within the passageway, wherein the bore of the passageway through the base has a constant diameter proximate the base second end, wherein a portion of the nipple proximate the bulkhead has an exterior surface, optionally tapered, in tight fit engagement with the bore of the passageway proximate the base second end to thereby form a second seal within the passageway; wherein the first seal and the second seal are spaced apart by a void region.

30. A casing for a firearms cartridge, comprising:

a metal sleeve having a length and a central length axis, the sleeve comprising a cylindrical wall portion running lengthwise from a first end to an opposing second end, the first end having a mouth shape for receiving a bullet, the second end comprising a circular bulkhead connected at a bulkhead outer edge to said cylindrical wall portion and running generally transverse to the sleeve length, the bulkhead having an exterior surface; the cylindrical wall and the bulkhead defining a concavity suited for receiving gunpowder propellant, the sleeve further comprising a nipple extending lengthwise from the bulkhead to a nipple terminal end, the nipple having a bore for enabling flow of propellant gases into said concavity; and, a base having a length and a lengthwise central axis, a first end, a second end having a circular surface in abutting close proximity to or in contact with the second end of the base, and a passageway running lengthwise between the first end and the second end, the passageway having a recess at the first end of the base, the recess larger in diametrical dimension than the rest of the passageway, defining a circumscribing shoulder within the passageway, and shaped for receiving a primer; wherein said sleeve nipple is positioned within the passageway;

wherein the terminal end of the sleeve nipple comprises a lip running radially outwardly relative to the sleeve central length axis, the lip in contact with said circumscribing shoulder of the base passageway, the lip having an annular surface that faces away from the base second end and is spaced apart from the base first end; and, wherein the sleeve comprises a cold-worked, unannealed austenitic stainless steel material, the sleeve having portions which are magnetic and have a magnetic permeability of at least 2 Mu.

31. The casing of claim 30 wherein said austenitic stainless steel material is selected from the group comprising AISI 304 steel, AISI 302 steel, AISI 308 steel and AISI 347 steel.

32. The casing of claim 30 wherein said sleeve has differing hardness and differing degree of magnetic permeability along the length thereof, the sleeve first end having higher hardness and higher magnetic permeability than the portion of the nipple sleeve which is between said lip and said bulkhead.

33. The casing of claim 30 wherein the base is made of a non-magnetic metal having a hardness that is less than the hardness of any portion of the sleeve.

34. The casing of claim 30 wherein the second end of the base and the cylindrical portion of the sleeve have substantially the same exterior circumference; and, wherein the base has a cannelure spaced apart from the second end.

35. A firearm cartridge comprising: a casing of claim 30; a primer positioned within the recess at the end of the base; a quantity of gunpowder within the concavity of the sleeve of the casing; and, a bullet positioned within the mouth first end of the sleeve of the casing.

* * * * *